US011401478B2

(12) United States Patent
Bayer

(10) Patent No.: US 11,401,478 B2
(45) Date of Patent: Aug. 2, 2022

(54) LUBRICANT AND METHOD FOR MANUFACTURING MAGNESIUM ALLOY TUBES

(71) Applicant: BIOTRONIK AG, Buelach (CH)

(72) Inventor: Ullrich Bayer, Bad Doberan (DE)

(73) Assignee: BIOTRONIK AG, Buelach (CH)

( * ) Notice: Subject to any disclaimer, the term of this patent is extended or adjusted under 35 U.S.C. 154(b) by 0 days.

(21) Appl. No.: 17/047,329

(22) PCT Filed: Apr. 17, 2019

(86) PCT No.: PCT/EP2019/059922
§ 371 (c)(1),
(2) Date: Oct. 13, 2020

(87) PCT Pub. No.: WO2019/219318
PCT Pub. Date: Nov. 21, 2019

(65) Prior Publication Data

US 2021/0163839 A1 Jun. 3, 2021

(30) Foreign Application Priority Data

May 17, 2018 (EP) ..... 18172886

(51) Int. Cl.
*C10M 101/00* (2006.01)
*B21C 23/12* (2006.01)
(Continued)

(52) U.S. Cl.
CPC ..... *C10M 1/00* (2013.01); *B21C 23/12* (2013.01); *B21C 23/32* (2013.01); *C10M 101/02* (2013.01);
(Continued)

(58) Field of Classification Search
CPC ... B21C 23/32; B21C 23/12; C10N 2040/245; C10N 2040/24; C10N 2010/12;
(Continued)

(56) References Cited

U.S. PATENT DOCUMENTS 2,486,130 A 10/1949 Dietrich et al.
2004/0092405 A1* 5/2004 Konishi ..... C10M 163/00 508/110

(Continued)

FOREIGN PATENT DOCUMENTS

GB 887065 1/1962

OTHER PUBLICATIONS

Hanada et al., "Fabrication of Mg alloy tubes for biodegradable stent application", Materials Science and Engineering C, 2013, pp. 4746-4750, vol. 33, Elsevier B.V.
Matsumoto et al., "Development of Warm Forging Method for Magnesium Alloy", Materials Transactions, 2004, pp. 2838-2844, vol. 45, No. 9, The Japan Society for Technology of Plasticity.
Wang et al., "Processing and properties of magnesium alloy micro-tubes for biodegradible vascular stents", Materials Science & Engineering C, 2018, pp. 504-513, vol. 90, Elsevier B.V.

(Continued)

*Primary Examiner* — Vishal V Vasisth
(74) *Attorney, Agent, or Firm* — Greer, Burns & Crain, Ltd.; Steven P. Fallon

(57) ABSTRACT

A lubricant includes at least 45 wt % paraffin oil, less than 8 wt % of a pyrophosphate or triphosphate, more than 6 wt % of a group 6 disulfide or diselenide and up to 27.5 wt % of graphite. The lubricant is used in a method for producing a magnesium alloy tube via extrusion, and is especially useful to form implants such as stents while maintaining the biocompatibility of the magnesium alloy.

16 Claims, 2 Drawing Sheets

(51) Int. Cl.

| | |
|---|---|
| ***B21C 23/32*** | (2006.01) |
| ***C10M 101/02*** | (2006.01) |
| *C10N 40/20* | (2006.01) |
| *C10N 10/04* | (2006.01) |
| *C10N 40/24* | (2006.01) |

(52) U.S. Cl.
CPC ..... *C10M 2201/0416* (2013.01); *C10M 2201/065* (2013.01); *C10M 2201/085* (2013.01); *C10N 2010/04* (2013.01); *C10N 2040/24* (2013.01); *C10N 2040/245* (2020.05)

(58) Field of Classification Search
CPC ..... C10N 2010/04; C10N 2040/244; C10M 169/04; C10M 169/02; C10M 101/02; C10M 1/00; C10M 2201/0416; C10M 2201/066; C10M 2207/28; C10M 2201/0666; C10M 2201/0856; C10M 2205/026; C10M 2201/085; C10M 2203/0206; C10M 2201/065
See application file for complete search history.

(56) References Cited

U.S. PATENT DOCUMENTS

| | | | | |
|---|---|---|---|---|
| 2011/0100081 | A1* | 5/2011 | Rau | C10M 111/04 72/42 |
| 2013/0218292 | A1 | 8/2013 | Bayer et al. | |
| 2019/0241824 | A1* | 8/2019 | Barton | C10M 169/04 |

OTHER PUBLICATIONS

Yu et al., "Microstructure and Mechanical Properties of AZ91D Extruded Tube", Acta Metallurgica Sinica (English Letters), Jun. 2006, pp. 203-208, vol. 19, No. 3, Science Direct.

Zheng et al., "Formability, mechanical and corrosive properties of Mg—Nd—Zn—Zr magnesium alloy seamless tubes", Materials and Design, 2010, pp. 1417-1422, vol. 31, Elsevier Ltd.

European Search Report from the corresponding European Patent Application No. 18172886.6, dated Nov. 12, 2018.

International Search Report from the corresponding International Patent Application No. PCT/EP2019/059922, dated Jul. 15, 2019.

* cited by examiner

LUBRICANT AND METHOD FOR MANUFACTURING MAGNESIUM ALLOY TUBES

PRIORITY CLAIM

This application is a 35 U.S.C. 371 US National Phase and claims priority under 35 U.S.C. § 119, 35 U.S.C. 365(b) and all applicable statutes and treaties from prior PCT Application PCT/EP2019/059922, which was filed Apr. 17, 2019, which application claimed priority from European Application EP18172886.6, which was filed May 17, 2018.

FIELD OF THE INVENTION

Fields of the invention include lubricants and direct or indirect tubular impact extrusion processes, particularly for manufacturing of magnesium alloy tubes, including magnesium alloy tubes processed into medical implants such as stents.

BACKGROUND

In a direct tubular impact extrusion process a metal is pushed through a die by a punch to form a hollow tube. In order to protect the tools, i.e., the die and the punch, a lubricant is applied to an inside of the die and on an outside of the punch.

However, particularly when extruding parts that are formed out of alloys that are difficult to extrude, such as brittle casting alloys and in particular magnesium alloys, and have final tube geometries and tolerances with relatively small lubrication gaps, a suitable lubricant has to be used in order to protect the extrusion tool and to maintain purity of the alloy to be extruded. This is particularly important when medical implants are made out of the extruded alloys which require a specific degree of biocompatibility and do not allow any toxic or irritating impurities introduced by the extrusion process or anywhere else.

In Hanada et al., "Fabrication of Mg alloy tubes for biodegradable stent applications," Material Science and Engineering C, vol. 33, 8, p. 4746 to 4750 an extrusion process for a Mg tube is disclosed. In Matsumoto & Osakado, "Development of Warm Forging Method for Magnesium Alloy," Materials Transactions, vol. 45, 9, 2004, p. 2838 to 2844 methods for warm gorging of magnesium alloys are disclosed. In Dietrich & Williams U.S. Pat. No. 2,486,130 lubricants for shaping magnesium and magnesium alloys are disclosed.

SUMMARY OF THE INVENTION

A preferred embodiment provides a lubricant that is particularly adapted for the use in an extrusion process for extruding brittle cast alloys, in particular magnesium alloys, particularly for producing magnesium alloy tubes that can be used as blanks for implantable medical implants such as stents. Such a stent may be used in a procedure denoted as angioplasty to ensure that a vessel of a patient widened during the procedure remains open.

Further aspects of the present invention relate to a use of the lubricant as well as to a method involving the lubricant.

The preferred embodiment lubricant preferably includes:

at least 45 wt % of a paraffin oil less than 8 wt % of a pyrophosphate or triphosphate, and in particular metal salts of the pyrophosphates or triphosphates, more than 6 wt % of a group 6 disulfide or diselenide, up to 27.5 wt % of graphite.

The pyrophosphates or triphosphates are preferably metal salts of the pyrophosphates or triphosphates, preferably of mono-, bi- and trivalent metals.

BRIEF DESCRIPTION OF THE DRAWINGS

In the following, embodiments/examples of the present invention shall be described with reference to the Figures, wherein.

DETAILED DESCRIPTION OF THE PREFERRED EMBODIMENTS

Figure 1:
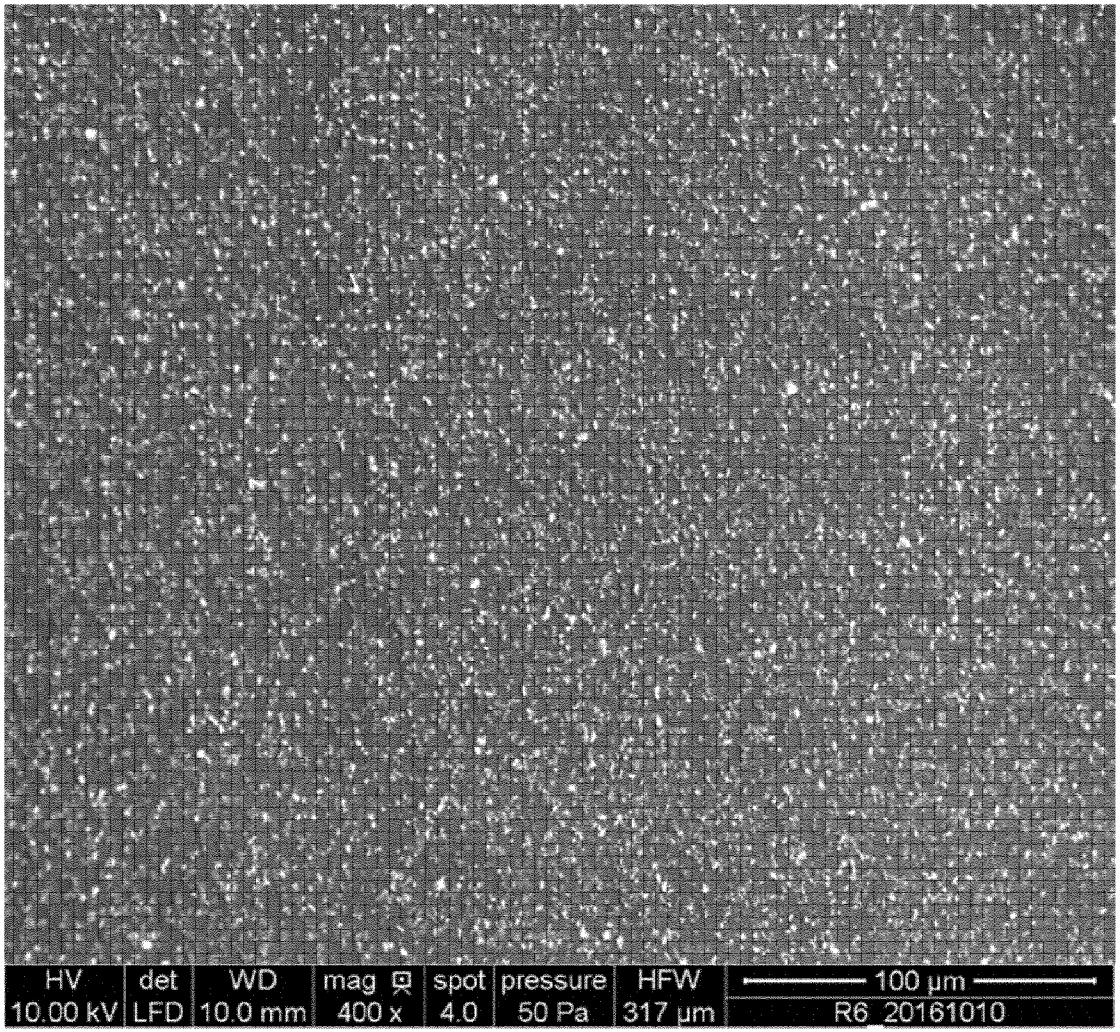
FIG. 1 shows a scanning electron microscope (SEM) image of an example of a lubricant according to the present invention after speed mixing; and the figure further shows an uniform distribution of the solid particles (bright) in the liquid matrix (darker background)

According to an embodiment of the lubricant according to the present invention, the paraffin oil amounts to a mass fraction of the lubricant of 45 wt % to 55 wt %, and further 47 wt % to 52 wt %. In one embodiment the paraffin oil amounts to a mass fraction of the lubricant with particularly 50 wt %. The paraffin oil preferably includes or consists of higher molecular aliphatic, saturated carbon hydrates. A typical example for paraffin oil can be derived as such as Weissöl Type PL 420 from manufacturer Parafluid Mineralölgesellschaft mbH.

Furthermore, in an embodiment, the paraffin oil preferably has a viscosity of 90 cSt [centistokes] to 100 cSt, particularly 100 cSt at a temperature of 40° C.

Particularly, the paraffin oil reduces friction between friction partners in the tool, wherein the viscous consistency of the paraffin oil particularly essentially determines the final viscosity of the lubricant.

Furthermore, according to an embodiment, the pyrophosphate or triphosphate amounts to a mass fraction of the lubricant of 4.0 wt % to 6.0 wt %, preferably 4.5 wt % to 5.5 wt %. In one embodiment, the pyrophosphate or triphosphate amounts to a mass fraction of the lubricant with particularly 5 wt %. Preferred embodiments of the pyrophosphate or triphosphate are zinc pyrophosphate, strontium pyrophosphate and calcium triphosphate. Particularly, zinc pyrophosphate acts as a solid lubricant for higher temperatures and further acts as a highly pressure-resistant, load-bearing release agent to minimize the interaction between tool and semi-finished product (e.g. magnesium alloy blank in the tool) and also minimizes friction.

Furthermore, according to an embodiment, the group 6 disulfide or diselenide amounts to a mass fraction of the lubricant of 8 wt % to 12 wt %, preferably 9 wt % to 11 wt %. In one embodiment, the group 6 disulfide or diselenide amounts to a mass fraction of the lubricant with particularly 10 wt %. In a preferred embodiment the group 6 disulfide or diselenide includes molybdenum disulfide, molybdenum diselenide, tungsten disulfide and tungsten diselenide. A group 6 element shall be a chemical element of group 6 of the periodic table of elements selected from chromium, molybdenum and tungsten. The radioactive element seaborgium should not be incorporated. Particularly, molybdenum disulfide provides a solid lubrication effect for lower temperatures up to approximately 320° C. Above that temperature $MoO_x$, in particular $MoO_3$, and $SO_2$ are generated in form of gas pockets which provide a separation effect as well as a lubrication effect. Particularly, in an embodiment, a maximum particle size (i.e. diameter) of the molybdenum disulfide particles is 7 μm, which provides a high lubrication effect also in case of very small lubrication gaps in the range from 15 μm to 80 μm.

Further, according to an embodiment, the graphite amounts to a mass fraction of the lubricant of 22.5 wt % to 27.5 wt %, preferably of 24 wt % to 26 wt %. In one embodiment, graphite amounts to a mass fraction of the lubricant with particularly 25 wt %. Particularly, the graphite functions to provide separation as well as a friction reducing solid lubricant for medium temperatures. Particularly, in an embodiment, the particle size of the graphite particles is smaller than 12 μm, which results in a lubrication effect also in case of very small lubrication gaps. In a particularly preferred embodiment, the particle size of the graphite particles is smaller than 9 μm. In a more preferred embodiment, the particle size of the graphite particles exhibits a size distribution that 90% of the particles are smaller than 9 μm, 50% of the particles are smaller than 5 μm and 10% of the particles are smaller than 2 μm. With such a distribution, it was found that the friction during the tube extrusion process could be minimized while the viscosity was still high enough to yield a satisfactory wettability towards the extrusion tools.

Further, according to an embodiment, the pyrophosphate or triphosphate, the group 6 disulfide or diselenide, and the graphite together amount to a mass fraction of the lubricant of 35 wt % to 45 wt %, particularly 39.2 wt % to 41 wt %, particularly 40 wt %.

Furthermore, according to an embodiment, the pyrophosphate or triphosphate as described herein and preferably zinc pyrophosphate is in the form of solid particles having a diameter median value (D50) in the range from 1 μm to 5 μm. Furthermore, according to an embodiment the group 6 disulfide or diselenide as described herein and preferably molybdenum disulfide is in the form of solid particles having a diameter median value (D50) in the range from 1 μm to 2 μm. Further, in an embodiment, the graphite is in the form of solid particles having a diameter median value (D50) in the range from 4 μm to 5 μm.

Median values of the diameters (D50) are defined as the value where half of the population resides above this point (i.e. have a larger diameter), and half resides below this point (i.e. have a smaller diameter). For particle size distributions the median is called the D50.

Furthermore, according to an embodiment, the lubricant further includes an ester oil, wherein preferably the ester oil amounts to a mass fraction of the lubricant in the range from 6 wt % to 9 wt %, preferably from 7 wt % to 8 wt %. Particularly, in one embodiment the ester oil amounts to a mass fraction of the lubricant with 7.5 wt %. Particularly, the ester oil acts as corrosion inhibitor with respect to the tool surface. Ester oils are mono-, di-tri- or multiple esters, the latter three linked via a short, preferably one to six carbon atoms long, hydrocarbon bridge between the ester carbonyl groups with a longer (more than 4 carbon atoms) branched or unbranched, substituted or unsubstituted, saturated or unsaturated hydrocarbon chain bond to the ester oxygen atom. Preferably, the hydrocarbon chain is, unbranched, unsubstituted and saturated.

Furthermore, in an embodiment, the ester oil has a viscosity in the range from 30 cSt to 36 cSt, particularly 33 cSt, at 40° C.

Furthermore, according to an embodiment, the lubricant further includes polybutylene, wherein preferably the polybutylene amounts to a mass fraction of the lubricant in the range from 1 wt % to 4 wt %, preferably from 2 wt % to 3 wt %. In one embodiment, the polybutylene amounts to a mass fraction of the lubricant with particularly 2.5 wt %.

Particularly, according to an embodiment, the polybutylene has a viscosity in the range from 270 cSt to 330 cSt, particularly 300 cSt, at 100° C.

Also, the polybutylene of the formula $H—(C_4H_8)_n—H$ preferably has n in the range of 4 to 20.

Further, polybutylene particularly contributes to the dynamical viscosity of the lubricant, which can be in the range from 6000 Pas to 25000 Pas, and leads to a good wettability on the tool and the magnesium alloy to be extruded. Furthermore, polybutylene improves the shear strength and the gliding effect of the tool and alloy to be extruded.

Particularly, the present invention is based on the fact that alloys such as magnesium alloys that are used in stent production require forming temperatures that are above 250° C. on a regular basis and can be as high as 430° C. for certain alloys. In these cases, extrusion processes without a suitable lubricant often cause destruction of the extrusion tool due to exceeding of load limits.

In a preferred embodiment of the invention the lubricant is constituted of

- 45 wt % to 55 wt % of paraffin oil,
- 6.0 wt % to 9.0 wt % of an ester oil,
- 4.0 wt % to 6.0 wt % of a pyrophosphate or triphosphate as described herein,
- 8 wt % to 12 wt % of a group 6 disulfide or diselenide as described herein,
- 22.5 wt % to 27.5 wt % graphite, and
- 1 wt % to 4 wt % polybutylene, with the provision that the amounts of zinc pyrophosphate, molybdenum disulfide and graphite do not exceed 45% and preferably are in the range of 35 wt % to 45 wt %, further with the provision that all ingredients add up to 100 wt %.

In a further preferred embodiment of the invention the lubricant is constituted of

- 47 wt % to 52 wt % of paraffin oil,
- 7.0 wt % to 8.0 wt % of an ester oil,
- 4.5 wt % to 5.5 wt % of a pyrophosphate or triphosphate as described herein,
- 9 wt % to 11 wt % of a group 6 disulfide or diselenide as described herein,
- 24 wt % to 26 wt % graphite, and
- 2 wt % to 3 wt % polybutylene, with the provision that the amounts of zinc pyrophosphate, molybdenum disulfide and graphite do not exceed 45% and preferably are in the range of 35 wt % to 45 wt %, further with the provision that all ingredients add up to 100 wt %.

In a preferred embodiment of the invention the lubricant is constituted of

- 45 wt % to 55 wt % of paraffin oil,
- 6.0 wt % to 9.0 wt % of an ester oil,
- 4.0 wt % to 6.0 wt % zinc pyrophosphate,
- 8 wt % to 12 wt % of molybdenum disulfide,
- 22.5 wt % to 27.5 wt % graphite, and
- 1 wt % to 4 wt % polybutylene, with the provision that the amounts of zinc pyrophosphate, molybdenum disulfide and graphite do not exceed 45% and preferably are in the range of 35 wt % to 45 wt %, further with the provision that all ingredients add up to 100 wt %.

In a further preferred embodiment of the invention the lubricant is constituted of 47 wt % to 52 wt % of paraffin oil,
7.0 wt % to 8.0 wt % of an ester oil,
4.5 wt % to 5.5 wt % zinc pyrophosphate,
9 wt % to 11 wt % of molybdenum disulfide,
24 wt % to 26 wt % graphite, and
2 wt % to 3 wt % polybutylene, with the provision that the amounts of zinc pyrophosphate, molybdenum disulfide and graphite do not exceed 45% and preferably are in the range of 35 wt % to 45 wt %, further with the provision that all ingredients add up to 100 wt %.

The lubricant according to the present invention is well-suited for such applications due to the fact that it includes both liquid and solid components that are particularly tailored to provide lubrication over a broad range of temperatures. Furthermore, due to the fact that the lubricant particularly does not contain metallic additives (e.g. for dissipating heat), the purity of the alloy to be extruded can be maintained.

Furthermore, the lubricant according to the present invention exhibits a couple of significant advantages in view of direct or indirect tubular impact extrusion process, especially when magnesium alloys are to be extruded. The lubricant possesses an excellent wettability regarding the surface of the magnesium alloy blank to be extruded. Furthermore, the consistency of the lubricant allows easy application to die and punch of the extrusion tool, which are preferably made out of a tool steel. Furthermore, particularly, the lubricant according to the present invention has a minimal chemical interaction with the surfaces of the magnesium alloy tubes. Furthermore, the lubricant does not cause severe coking of the tool, which allows easy mechanical cleaning of the extrusion tool (i.e. die and punch) after extrusion.

Furthermore, the lubricant particularly does not contain elements/substances that diffuse into the tube walls of the tube to be formed during extrusion, which helps to maintain biocompatibility of the final magnesium alloy tube.

Further, particularly, the lubricant is configured to develop gases during extrusion for providing a gas pocket lubrication effect, particularly due to the specific ratio of liquid and solid components. Furthermore, particularly, a lubrication effect is present even with small lubrication gaps (distance between blank and tool surfaces) due to small particle sizes of solid lubricant components.

Finally, particularly, the lubricant according to the present invention does not cause an increased tool wear since abrasive components such as hard ceramic particles (e.g. boron nitride or corundum) are preferably absent.

According to a further aspect of the present invention, a use of a lubricant according to the present invention in an extrusion process, particularly in a direct or indirect tubular impact extrusion process is disclosed, particularly for extruding a magnesium alloy tube.

According to an embodiment of the use the magnesium alloy tube forms a blank for forming a stent, particularly a biodegradable and/or drug eluting stent.

According to a further embodiment of the use, the extrusion process is a direct tubular impact extrusion process using e.g. a die and a punch.

According to yet another aspect of the present invention a method for producing a magnesium alloy tube using a tool including a die and a punch is disclosed, wherein a magnesium alloy is extruded to form a magnesium alloy tube using the tool, and wherein the die and/or the punch is lubricated with a lubricant according to the present invention.

According to an embodiment of the method, the magnesium alloy is extruded by direct tubular impact extrusion, wherein a die is provided that includes a through hole extending from a back side of the die to a front side of the die, wherein a first section of the through hole extending from the back side of the die has a constant inner diameter and a succeeding second section of the through hole tapers towards an opening on the front side of the die, through which opening the alloy is pushed, i.e., extruded out of the die.

Further, for extruding the alloy out of the opening, a punch is provided that has a cylindrical first section connected to a cylindrical second section, wherein the first section of the punch has an outer diameter that is smaller than an outer diameter of the second section of the punch and smaller than an inner diameter of the opening of the die and smaller than the inner diameter of the first section of the through hole, and wherein particularly the outer diameter of the second section of the punch corresponds to the inner diameter of the first section of the through hole, so that the second section of the punch can slide in the first section of the through hole.

Further, according to an embodiment of the method, a cylindrical magnesium alloy blank is inserted into the through hole from the back side of the die, and the punch is moved into the through hole from the back side of the die with the first section ahead such that the metal is pushed by the second section of the punch through a circumferential gap formed between the first section of the punch and the opening on the front side of the die.

The width of the gap thus determines the width of the wall of the extruded tube while the outer diameter of the first section of the punch determines the inner diameter of the extruded tube.

Furthermore, according to an embodiment of the method, the extruded magnesium alloy tube is further processed to form a stent.

Further processing of the tube/stent may include one of: cutting the tube to form a stent having a plurality of connected struts, coating the tube or struts with a chemical substance, wherein particularly the chemical substance includes or is a drug.

As an example of the present invention, the following lubricant composition 1 to 4 can be used in the process described further below:

Composition 1:
Paraffin oil 45 wt %,
Ester oil 8 wt %,
Zinc pyrophosphate 6.0 wt %,
Tungsten disulfide 12.0 wt %,
Graphite 25.0 wt %, and
Polybutylene 4 wt %.

Composition 2:
Paraffin oil 55 wt %,
Ester oil 7.5 wt %,
Calcium triphosphate 4.0 wt %,
Molybdenum disulfide 9.0 wt %,
Graphite 22.5 wt %, and
Polybutylene 2 wt %.

Composition 3:
Paraffin oil 48 wt %,
Ester oil 8 wt %,
Strontium pyrophosphate 5.0 wt %,
Molybdenum diselenide 9.0 wt %,
Graphite 26.0 wt %, and
Polybutylene 3 wt %.

Composition 4:
Paraffin oil 50 wt %,
Ester oil 7.5 wt %,
Zinc pyrophosphate 5.0 wt %,
Molybdenum disulfide 10.0 wt %,
Graphite 25.0 wt %, and
Polybutylene 2.5 wt %.

As paraffin oil a hydrogenated, fully saturated hydrocarbon, including an alkane or a mixture of alkanes $C_nH_{2n+2}$ wherein n is between 18 and 32 (e.g. Pharma Weißöl PL 420 of PARAFLUID GmbH, Germany), having a viscosity of 100 cSt (centistokes) at 40° C. was used. Further, as zinc pyrophospate ($Zn_2P_2O_7$), Z 34-80 of BUDENHEIM, Germany, and strontium pyrophosphate, 773921 of Sigma Aldrich can be used. Furthermore, as molybdenum disulfide ($MoS_2$) e.g. MOLYSULFIDE Super fine Grade of Climax Molybdenum, Netherlands, can be used (98% $MoS_2$ D50 1-2 μm). As graphite, e.g. UF2 99.9 of Graphit Kropfmühl GmbH, Germany, can be used (99.5 to 99.9% C, D50 4-5 μm). As ester oil, e.g. Unifluid 32 of FUCHS Schmierstoffe GmbH, Germany, can be used (viscosity of 33 cSt [centistokes] at 40° C.). Finally, as polybutylene ($(C_4H_8)_n$), e.g. INDOPOL H-15 of INEOS Oligomers, Belgium, can be used (viscosity of 300 cSt at 100° C.).

The exemplary lubricating oils have a black-grey, homogeneous, paste-liquid, supple appearance.

The calculated density of the lubricants amounts to 1.70 g/cm$^3$, and the dynamical viscosity ranges value from 6.000+/−25.000 Pas at room temperature (20° C.-22° C.).

Particularly, FIG. 1 shows the above stated lubricant composition after speed mixing. As can be seen from FIG. 1, the lubricant provides an advantageous homogenous distribution of its components.

COMPARATIVE EXAMPLE

Composition 5
Paraffin oil 44 wt %,
Ester oil 10 wt %,
Zinc pyrophosphate 10.0 wt %,
Molybdenum disulfide 5.0 wt %,
Graphite 27.5 wt %, and
Polybutylene 5.0. wt %

Composition 5 exhibited a coarse, non-homogeneous appearance. The material could not well be applied to the tools and too much pressure was required for the extrusion process. Hence, the lubricating properties of composition 5 were insufficient.

Figure 2:
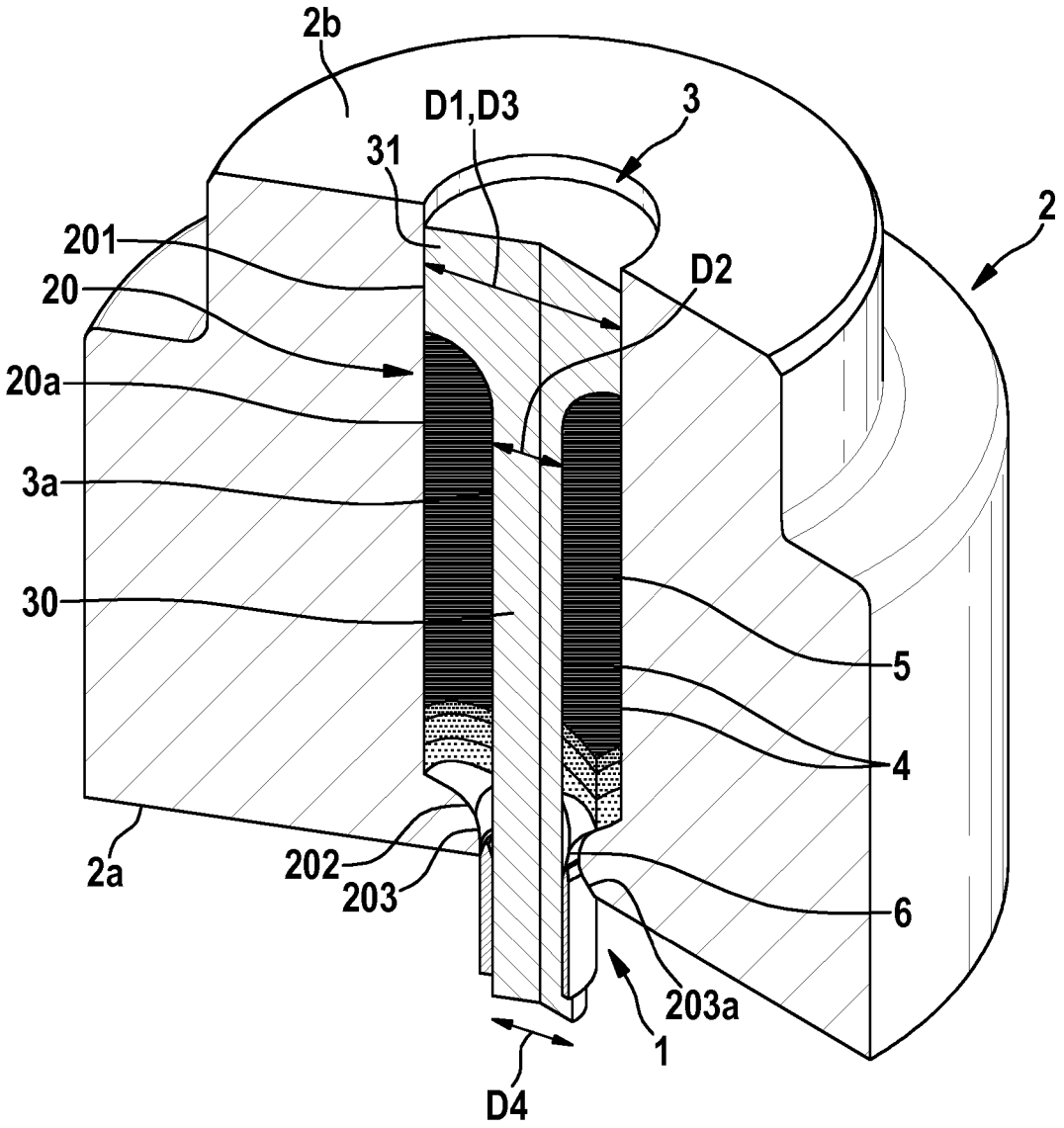
FIG. 2 shows illustrates an embodiment of a method according to the present invention using a lubricant according to the present invention.

FIG. 2 illustrates an embodiment of the method according to the present invention. Here, the lubricant 4 according to the present invention, particularly having the composition of the example stated above, is used to lubricate the tool/blank.

In order to extrude a magnesium alloy tube 1, e.g. made from a WE 43 alloy, e.g. in a forward hollow extrusion process, a die 2 and a punch 3 are used, wherein a surface 20*a* of the die 2 and a surface 3*a* of the punch 3 which interact with the alloy to be extruded are lubricated with the lubricant 4 as indicated in FIG. 2

Particularly, the die 2 includes a through hole 20 extending from a back side 2*b* of the die 2 to a front side 2*a* of the die 2, wherein a first section 201 of the through hole 20 extending from the back side 2*b* of the die 2 has a constant inner diameter D1 and a succeeding second section 202 of the through hole 20 tapers towards an opening 203 on the front side 2*a* of the die 2.

The punch 3 has a cylindrical first section 30 connected to a cylindrical second section 31 of the punch 3, wherein the first section 30 of the punch 3 has an outer diameter D2 that is smaller than an outer diameter D3 of the second section 31 of the punch 3 and smaller than an inner diameter D4 of the opening 203 of the die 2. Further, the outer diameter D3 of the second section 31 of the punch 3 corresponds to the inner diameter D1 of the first section 201 of the through hole 20 which guides the punch 3. For extruding the tube 1 a cylindrical magnesium alloy blank 5 is inserted into the through hole 20 from the back side 2*b* of the die 2, and the punch 3 is pushed into the through hole 20 from the back side 2*b* of the die 2 with the first section 30 of the punch 3 ahead such that the magnesium alloy 5 is pushed by the second section 31 of the punch 3 through a circumferential gap 6 formed between the first section 30 of the punch 3 and a boundary 203*a* of the opening 203 on the front side 2*a* of the die 2.

After extrusion of the tube 1, the latter can be processed to form a stent. Such processing of the tube/stent may include one of: cutting the tube to form a stent having a plurality of connected struts, coating the tube or struts with a chemical substance, wherein particularly the chemical substance includes or is a drug.

The invention claimed is:

1. A lubricant comprising a liquid matrix with a uniform distribution of solid particles, wherein the liquid matrix comprises:
at least 45 wt % of a paraffin oil, and the solid particles comprise
4 wt % to 8 wt % of a pyrophosphate or triphosphate,
more than 6 wt % of a group 6 disulfide or diselenide, and
22.5 wt % to 27.5 wt % of graphite.

2. The lubricant according to claim 1, comprising 45 wt % to 55 wt % paraffin oil.

3. The lubricant according to claim 1, comprising 4 wt % to 6 wt % pyrophosphate or triphosphate.

4. The lubricant according to claim 1, comprising 8 wt % to 12 wt % group 6 disulfide or diselenide.

5. The lubricant according to claim 1, wherein the pyrophosphate or triphosphate, the group 6 disulfide or diselenide, and said graphite together amount to a mass fraction of the lubricant of 35 wt % to 45 wt %.

6. The lubricant according to claim 1, wherein the pyrophosphate or triphosphate comprises solid particles having a diameter median value (D50) in the range from 1 μm to 5 μm.

7. The lubricant according to claim 1, comprising 6 wt % to 9 wt % ester oil.

8. The lubricant according to claim 1, comprising 1 wt % to 4 wt % polybutylene.

9. An extrusion process comprising: applying the lubricant according to claim 1 to an extrusion tool and pushing magnesium alloy through the extrusion tool with the lubricant present in the extrusion tool.

10. The extrusion process according to claim 9, wherein the magnesium alloy tube is a blank for forming a stent.

11. The extrusion process according to claim 9, wherein the extrusion tool performs a process that is a direct or indirect tubular impact extrusion process.

12. A method for producing a magnesium alloy tube comprising lubricating a surface of a die and/or a punch with a lubricant according to claim 1 and extruding a magnesium alloy using the die and the punch.

13. The method according to claim 12, comprising processing the extruded magnesium alloy tube to form a stent.

14. The lubricant according to claim 1, wherein the pyrophosphate or triphosphate are metal salts of the pyrophosphates or triphosphates.

15. The lubricant according to claim 1, wherein the group 6 disulfide or diselenide comprises solid particles having a diameter median value (D50) in the range from 1 μm to 2 μm.

16. The lubricant according to claim 1, wherein said graphite comprises solid particles having a diameter median value (D50) in the range from 4 μm to 5 μm.

* * * * *